US010448166B2

(12) United States Patent
Chen

(10) Patent No.: US 10,448,166 B2
(45) Date of Patent: Oct. 15, 2019

(54) ULTRA-THIN PLANAR MAGNETIC FILM FULL-FREQUENCY SPEAKER

(71) Applicant: Tymphany Acoustic Technology (Huizhou) Co., Ltd., Huizhou (CN)

(72) Inventor: Zhiwen Chen, Taipei (TW)

(73) Assignee: Tymphany Acoustic Technology (Huizhou) Co., Ltd., Huizhou (CN)

( * ) Notice: Subject to any disclaimer, the term of this patent is extended or adjusted under 35 U.S.C. 154(b) by 0 days.

(21) Appl. No.: 15/680,650

(22) Filed: Aug. 18, 2017

(65) Prior Publication Data

US 2018/0332400 A1 Nov. 15, 2018

(30) Foreign Application Priority Data

May 11, 2017 (CN) ..... 2017 1 0327661

(51) Int. Cl.

| | |
|---|---|
| ***H04R 9/06*** | (2006.01) |
| ***H04R 9/02*** | (2006.01) |
| ***H04R 7/04*** | (2006.01) |
| ***H04R 31/00*** | (2006.01) |
| ***H04R 7/18*** | (2006.01) |
| ***H04R 9/04*** | (2006.01) |

(52) U.S. Cl.

CPC ..... *H04R 9/06* (2013.01); *H04R 7/04* (2013.01); *H04R 7/18* (2013.01); *H04R 9/025* (2013.01); *H04R 9/047* (2013.01); *H04R 31/003* (2013.01); *H04R 2307/025* (2013.01); *H04R 2307/027* (2013.01); *H04R 2400/11* (2013.01)

(58) Field of Classification Search

CPC ..... H04R 9/06; H04R 9/025; H04R 9/047; H04R 7/04; H04R 7/18; H04R 7/22; H04R 31/003; H04R 2307/025; H04R 2307/027; H04R 2400/11; H04R 9/04; B60R 11/0217

See application file for complete search history.

(56) References Cited

U.S. PATENT DOCUMENTS 3,066,200 A * 11/1962 Pavlak ..... H04R 9/047 381/408
3,997,739 A * 12/1976 Kishikawa ..... H04R 9/047 381/408

(Continued)

*Primary Examiner* — Md S Elahee
*Assistant Examiner* — Angelica M McKinney
(74) *Attorney, Agent, or Firm* — Muncy, Geissler, Olds & Lowe, P.C.

(57) ABSTRACT

An ultra-thin planar magnetic film full-frequency speaker comprises a vibration system, a magnetic system, a frame, and an acoustic foam. The vibration system and the magnetic system are received and fixed in the interior of the frame. The vibration system comprises a vibration film and a planar voice coil, the vibration film forming a contiguous inward recess structure in the middle thereof, the planar voice coil being provided with a bar-like aperture, and the planar voice coil being adhered and fixed to the vibration film The magnetic system comprises a U-shaped soft iron and a bar-shaped magnet, the bar-shaped magnet being disposed above the U-shaped soft iron and disposed beneath the bar-shaped aperture, the U-shaped soft iron being connected to the frame by means of injection molding, and the acoustic foam being adhered to a bottom face of the U-shaped soft iron.

10 Claims, 6 Drawing Sheets

(56) References Cited

U.S. PATENT DOCUMENTS

| | | | | |
|---|---|---|---|---|
| 5,836,203 | A * | 11/1998 | Martin | B06B 1/04 73/579 |
| 6,934,402 | B2 * | 8/2005 | Croft, III | H04R 7/22 381/191 |
| 8,712,092 | B2 * | 4/2014 | Wei | H04R 9/025 381/398 |
| 2002/0061116 | A1 * | 5/2002 | Hara | H04R 7/04 381/413 |
| 2005/0031153 | A1 * | 2/2005 | Nguyen | H04R 9/025 381/414 |
| 2005/0135653 | A1 * | 6/2005 | Steere | B60R 11/0217 381/431 |
| 2007/0076915 | A1 * | 4/2007 | Shin | H04R 7/04 381/400 |
| 2018/0098156 | A1 * | 4/2018 | Jacques | H04R 9/047 |

* cited by examiner

ULTRA-THIN PLANAR MAGNETIC FILM FULL-FREQUENCY SPEAKER

TECHNICAL FIELD

The present invention relates to the technical field of speaker manufacturing, and in particular, relates to an ultra-thin planar magnetic film full-frequency speaker.

BACKGROUND

With advancement of the society and development of science and technology, people's life standards are becoming higher and higher. At present, smart homes, ultra-thin televisions, portable speakers and the like electronic products are popular, which all impose a requirement on the thickness of the product. In the aspect of the product structure of the speakers, high-performance thin full-frequency speakers are also desired.

Moving coil speakers are speakers most extensively applied worldwide. A moving coil speaker is formed of a magnetic system and a vibration system. The magnetic system comprises an upper magnetic conduction plate, a magnet and a lower magnetic conduction plate. The vibration system comprises a tampered (or spherical) vibration film and a voice coil. In a traditional voice coil, a conductive coil surrounds a cylindrical frame. Therefore, the thickness of the moving coil speaker includes the heights of the magnetic system and the tampered (or spherical) vibration film, and also includes a portion of the voice coil height. If the moving coil speaker needs to be made thinner, the product performance would be sacrificed, for example, a lower sensitivity, a lower power handling, an increased resonant frequency and the like. As such, the requirements imposed by the currently popular ultra-thin electrode devices on high voice quality and high performance may not be accommodated.

In a traditional planar magnetic film speaker, the magnetic system comprises only a magnet and a lower magnetic conduction plate, and the integral thickness can be made thinner. Since the vibration film and the voice coil are plane-shaped and the thickness is initially small, the total thickness of the product is small. However, since the vibration amplitude of the vibration film in the traditional planar magnetic film speaker is small, which is generally 0.5 mm only, The compliance of the vibration film may only be provided by a pre-tension force of the vibration film and an elastic deformation of the vibration film when the vibration film is adhered to the frame. Therefore, the compliance of the vibration film is small, and the resonant frequency is high. In this way, although the traditional planar magnetic film speaker is thin, the planar magnetic film speaker may be used as a high-frequency speaker only.

Therefore, based on the above factors, how to design a compact and thin full-frequency speaker is a technical problem to be urgently solved for a person skilled in the art.

SUMMARY OF THE INVENTION

To solve the above technical problem in the prior art, the present disclosure provides an ultra-thin planar magnetic film full-frequency speaker. In combination with the advantages of great mechanical excursion and low resonant frequency of a moving coil speaker and in consideration of the traditional planar magnetic film speaker, a full-frequency speaker having a small thickness (≤8 mm) and good performance is designed, which may be extensively applied in thin and light-weighted electronic devices.

An ultra-thin planar magnetic film full-frequency speaker comprises a vibration system, a magnetic system, a frame, and an acoustic foam; wherein the vibration system and the magnetic system are received and fixed in the interior of the frame; the vibration system comprises a vibration film and a planar voice coil, the vibration film forming a contiguous inward recess structure in the middle thereof, the planar voice coil being provided with a bar-like aperture, and the planar voice coil being adhered and fixed to the vibration film; and the magnetic system comprises a U-shaped soft iron and a bar-shaped magnet, the bar-shaped magnet being disposed above the U-shaped soft iron and disposed beneath the bar-shaped aperture, the U-shaped soft iron being connected to the frame by means of injection molding, and the acoustic foam being adhered to a bottom face of the U-shaped soft iron.

The ultra-thin planar magnetic film full-frequency speaker employs a structure compact and ultra-thin innovative design. In the structure of the speaker, the vibration film forms a contiguous recess structure in the middle, and the planar voice coil is provided with bar-shaped apertures to ensure that the voice coil is capable of passing through the bar-shaped magnet during vibration of the vibration film and ensure that the vibration stroke of the full-frequency speaker is satisfied in the magnetic system. Since the planar voice coil has a thickness of only 0.1 mm and the vibration film has a thickness of 2.9 mm, the integral vibration system has a thickness of only 3 mm. In addition, since the upper magnetic conduction plate of the traditional moving coil speaker is not provided, the integral magnetic system may be made to be very thin, and the integral magnetic system has a thickness of only 4 mm, which satisfies the design requirement of the ultra-thin structure while achieving the full-range performance.

In addition, the U-shaped soft iron and the frame are connected by means of injection molding, and are made into an integral body by means of in-mold injection molding. This not only saves the assembling time, but also achieves a higher assembling precision. In addition, this prevents the vibration film from contacting the side face of the magnet during up-down vibration.

Further, the vibration film comprises a vibration plate and an edge surrounding the vibration plate, wherein the vibration film is fixed and connected to the edge by means of bonding or in-mold injection molding, and the vibration film is adhered and fixed to the frame by means of the edge. The vibration plate is made from a rigid material, and the edge is made from a flexible material. The vibration plate and the edge are connected and fixed by means of by means of bonding or in-mold injection molding, which ensures security and stability of the bonding.

Further, the vibration plate downwardly forms a contiguous square groove, and the vibration plate has a square wave form-shaped section. The vibration plate is downwardly recessed to form a contiguous square groove, and has a square wave structure as seen from the sectional view thereof. This feature design is to cause the vibration plate to be close to the bar-shaped magnet as much as possible, and meanwhile it also needs to be ensured that the vibration film, within the mechanical stroke thereof, may not contact the U-shaped soft iron 21 and the bar-shaped magnet.

Further, the vibration plate is made from an aluminum magnesium alloy or a plastic polymer material, and the vibration plate is additionally provided with a reinforcing rib. The vibration plate may be made from an aluminum magnesium alloy or a plastic polymer material, which not only ensures light-weight of the vibration plate, but also ensures sufficient rigidity of the vibration plate. In addition, the vibration plate is additionally provided with a reinforcing rib, which enhances the integral rigidity.

Further, the edge is downwardly recessed to form an inner R-shaped structure, or upwardly protrudes to form an outer R-shaped structure, or upwardly protrudes twice to form a double-outer R-shaped structure, or consecutively upwardly protrudes to form a W-shaped structure; and the edge is made from a rubber material or a polyurethane material or a silk material, and the edge is additionally provided with a reinforcing rib.

Further, the edge is made from a rubber material that is downwardly recessed to form an inner R-shaped structure. The compliance of the vibration system is controlled by regulating the hardness of the rubber and the thickness of the edge, thereby controlling the resonant frequency. The resonant frequency of the full-frequency speaker is ensured to be lower than 200 Hz, which satisfies the requirement of full-frequency sounding. In addition, a reinforcing rid is additionally provided in the R-shaped edge, which flexibly adjusts the vibration mode of the edge.

Further, the planar voice coil comprises a conductive coil and a planar thin film, the conductive coil being printed on the planar thin film, and the bar-shaped aperture being provided in the planar thin film, such that the planar thin film is capable of passing through the bar-shaped magnet during up-down vibrations.

Further, the conductive coil comprises a linear coil portion and a bent coil portion, the linear coil portion being adhered and fixed to the contiguous square groove, and the bent coil portion being adhered to two sides of the vibration film. The linear coil portion is used as an effective coil, and flatly adhered to a lower surface of the contiguous square groove of the vibration plate, and configured to perform electricity-power energy conversion when an alternating current signal is input, thereby ensuring up-down vibration of the vibration plate.

Further, the bottom of the U-shaped soft iron is provided with a vent hole, the acoustic foam being adhered to the vent hole.

The bottom of the U-shaped soft iron is provided with a vent hole, which effectively reduces the air resistance in the magnetic system during vibration of the vibration film, and facilitates the compliance of the vibration system. The acoustic foam is adhered to the bottom face of the U-shaped soft iron, and is adhered to the vent hole, which may effectively reduce wind noise when the air passes through the vent hole at the bottom of the U-shaped soft iron at a very high speed during operation of the full-frequency speaker.

Further, the bar-shaped magnet is a rectangular neodymium magnet, and each bar-shaped magnet is formed of three small square magnets. The bar-shaped magnet is used to provide a permanent magnetic field for the planar voice coil, and employs a magnet with a high magnetic energy product. Preferably, the bar-shaped magnet is a neodymium magnet. To solve the problem that the bar-shaped magnet has a large length which is unfavorable to production, each bar-shaped magnet is formed of three small square magnets, which bring convenience to the production.

Further, the ultra-thin planar magnetic film full-frequency speaker has an integral thickness of not greater than 8 mm, which satisfies the design requirement of the ultra-thin structure.

Based on the above technical solution, the embodiments described herein provide the following beneficial effects:

(1) The novel ultra-thin planar magnetic film full-frequency speaker, integrating the advantages of the moving coil speaker and the planar magnetic film speaker, has a simple and compact structure, and employs a magnetic path design similar to that of the planar magnetic film, with a height being controlled within 8 mm. In addition, the planar voice coil is adhered to the vibration film having a special shape as the driving force, and the inner R-shaped edge design is used. In this way, a specific mechanical excursion is ensured, and the compliance of the edge is increased to lower the resonant frequency. Meanwhile, the vibration film is subject to a uniform force, there are few the partition vibrations and rocking modes, the effective frequency domain is wide, thereby forming an ultra-thin full-frequency speaker (150 Hz to 20 kHz), which is extensively applied in small and light-weighted electronic devices.

(2) In the ultra-thin planar magnetic film full-frequency speaker, the U-shaped soft iron is connected to the frame by means of injection molding to form an integral design based on in-mold injection molding, thereby not only reducing the adhesive dispensing process during the production of the speakers, but also saving the assembling time and manpower and improves the production efficiency. In addition, the assembling precision is higher, and the cases of air leakage and sound leakage are prevented.

(3) The ultra-thin planar magnetic film full-frequency speaker has a wide directivity, has no front cavity effect, and has good off-axis response; and the ultra-thin planar magnetic film full-frequency speaker has a flat impedance curve, a small inductive reactance and motional impendence, and good integral performance.

DETAILED DESCRIPTION

For better understanding of the disclosed embodiments the exemplary embodiments are described in detail with reference to attached drawings and specific embodiments. The accompanying drawings show preferential embodiments. However, the embodiments may be implemented in a plurality of forms or ways, and is not limited to the embodiments described herein. On the contrary, these embodiments are provided to make the understanding of the disclosed contents more thorough and comprehensive.

Embodiment 1

Figure 1:
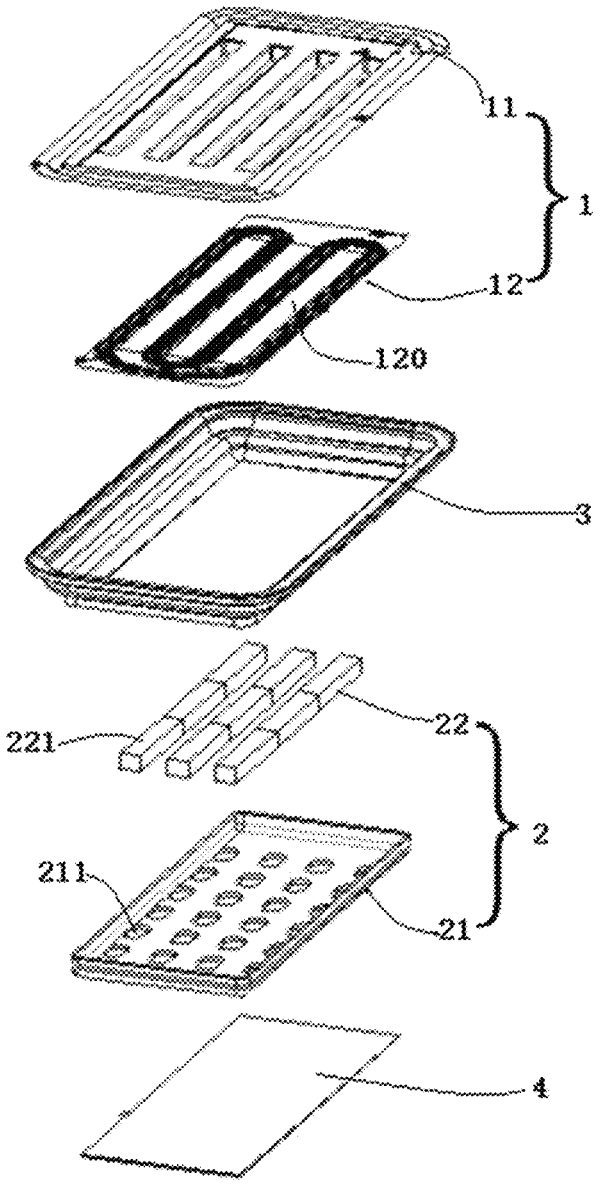
FIG. 1 is an exploded view of an ultra-thin planar magnetic film full-frequency speaker.
Figure 2:
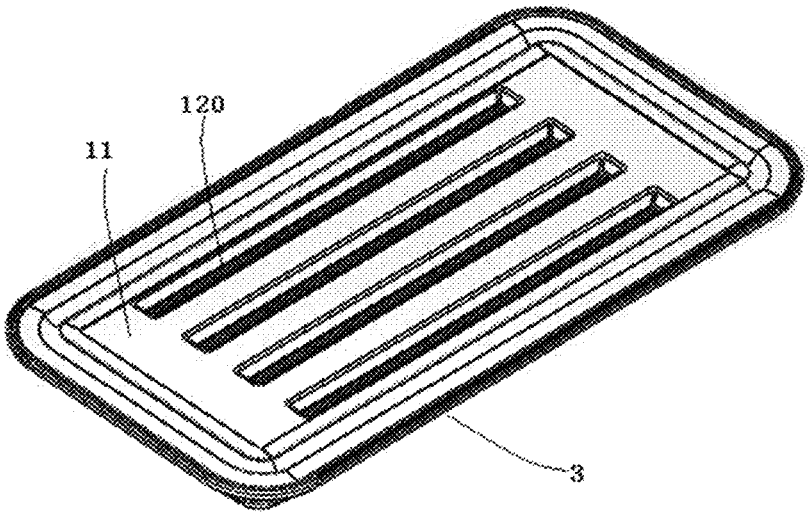
FIG. 2 is a finished product view of the ultra-thin planar magnetic film full-frequency speaker.
Figure 3:
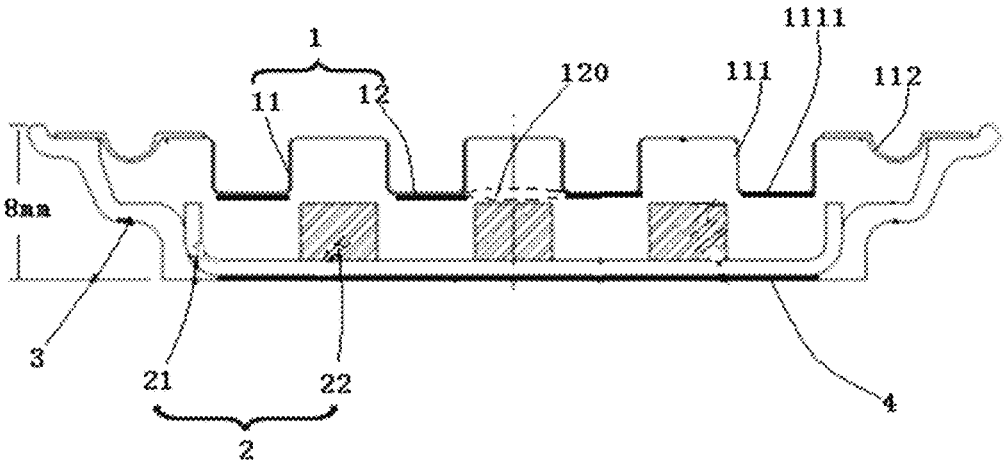
FIG. 3 is a sectional view of the ultra-thin planar magnetic film full-frequency speaker.

FIG. 1 to FIG. 3 respectively provide an exploded view, a finished product view and a sectional view of an ultra-thin planar magnetic film full-frequency speaker. With reference to FIG. 1 to FIG. 3, the ultra-thin planar magnetic film full-frequency speaker comprises a vibration system 1, a magnetic system 2, a frame 3, and an acoustic foam 4; wherein the vibration system 1 and the magnetic system 2 are received and fixed in the interior of the frame 3. The vibration system 1 comprises a vibration film 11 and a planar voice coil 12, and the magnetic system 2 comprises a U-shaped soft iron 21 and a bar-shaped magnet 22.

Figure 4:
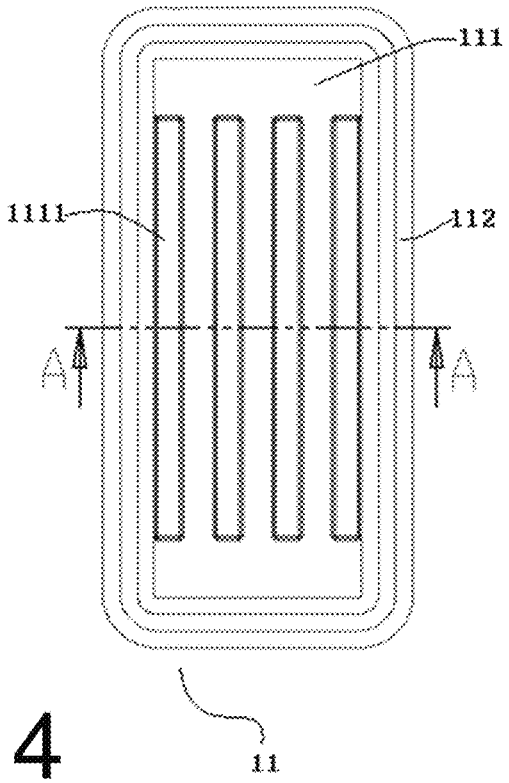
FIG. 4 is a top view of the ultra-thin planar magnetic film full-frequency speaker.

FIG. 4 provides a top view of a vibration film according to this embodiment. As illustrated in FIG. 4, in the vibration system 1, the vibration film 11 has a rectangular flat structure, and the vibration film 11 forms a contiguous recess structure in the middle thereof, and comprises a rigid vibration plate 111 disposed at a middle position and an edge 112 disposed at an edge position that surrounds the vibration plate 111. The rigid vibration film 11 and the flexible edge 112 are connected and fixed by means of by means of bonding or in-mold injection molding, which ensures security and stability of the bonding.

It should be noted that the vibration downwardly forms a contiguous square groove 1111, which is not a simple flat structure and is a square wave structure as seen from the sectional view thereof. This feature design is to cause the vibration plate 111 to be close to the bar-shaped magnet 22 as much as possible, and meanwhile it also needs to be ensured that the vibration film 11, within the mechanical stroke thereof, may not contact the U-shaped soft iron 21 and the bar-shaped magnet 22.

In the aspect of materials, the vibration plate 111 may be made from a metal sheet by means of stamping molding or made from a plastic polymer material. In this embodiment, the vibration plate 111 is manufactured with an aluminum magnesium alloy by means of stamping molding. This not only ensures light weight of the vibration plate 111, but also ensures sufficient rigidity of the vibration plate 111. In addition, the vibration plate 111 is further provided with some reinforcing ribs, which further improves the integral rigidity of the vibration plate 111.

Further referring to FIG. 3, the edge 122 of the vibration film 11 may be made from a rubber material or a polyurethane material or a silk material. Meanwhile referring to the schematic structural view of different shapes formed by the edge according to this embodiment, the edge 122 may be downwardly recessed to form an inner R-shaped structure, or upwardly protrude to form an outer R-shaped structure, or upwardly protrude twice to form a double-outer R-shaped structure, or consecutively upwardly protrude to form a W-shaped structure. In this embodiment, the edge 122 is made from a rubber material that is downwardly recessed to form an inner R-shaped structure, and compliance of the vibration system 11 is controlled by regulating the hardness of the rubber and the thickness of the edge 122, thereby controlling the resonant frequency. In this embodiment, by adjusting the inner R-shaped edge 122, it may be ensured that the resonant frequency of the full-frequency speaker is lower than 200 Hz, which satisfies the requirement of full-frequency sounding. In addition, a reinforcing rid is additionally provided in the R-shaped edge, which flexibly adjusts the vibration mode of the edge.

Figure 5:
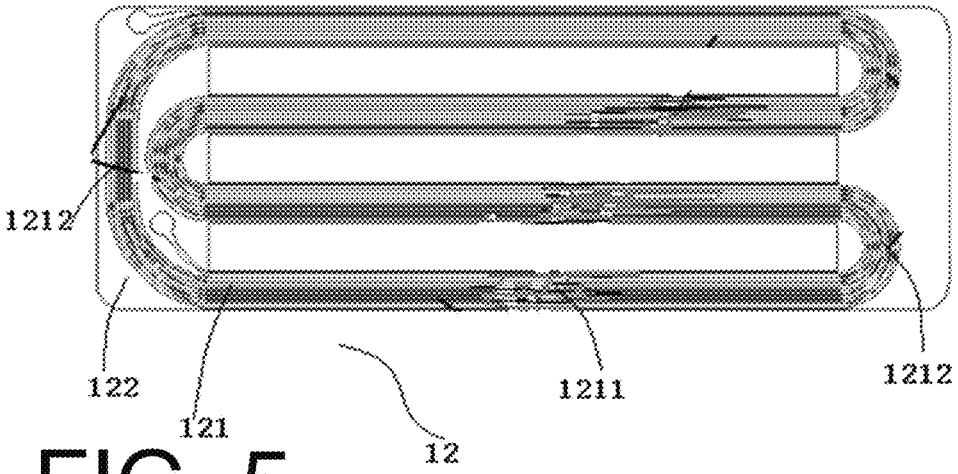
FIG. 5 is a schematic structural view of a planar voice coil.

FIG. 5 provides a schematic structural view of a planar voice coil according to this embodiment. As illustrated in FIG. 5, as a core member for electricity-power energy conversion, the planar voice coil 12 comprises a conductive coil 121 and a planar thin film 122, wherein the conductive coil 121 is printed on the planar thin film 122. The planar voice coil 12 is provided with a bar-shaped aperture 120, and the planar voice coil 12 is adhered and fixed to the vibration film 11.

It should be noted that the bar-shaped aperture 120 is provided in the middle of the planar thin film 122. In this embodiment, the bar-shaped aperture 120 is a rectangular shape, and totally three bar-shaped apertures 120 are provided, which corresponding to the number of bar-shaped magnets 22, to ensure that the apertures may pass through the bar-shaped magnets 22 during up-down vibration.

The conductive coil 121 further comprises a linear coil portion 1211 and a bent coil portion 1212, wherein the linear coil portion 1211 is adhered and fixed to the contiguous square groove, and the bent coil portion 1212 is adhered to two sides of the vibration film 11. The linear coil portion 1211 is used as an effective coil, and flatly adhered to a lower surface of the contiguous square groove 1111 of the vibration plate 111, and configured to perform electricity-power energy conversion during up-down vibration.

In the vibration system 1 of the full-frequency speaker as described in this embodiment, since the planar voice coil 12 has a thickness of only 0.1 mm, and the vibration film 11 has a thickness of 2.9 mm, the integral vibration system 1 has a thickness of only 3 mm, which satisfies the design requirement of the ultra-thin structure.

Still referring to FIG. 1 to FIG. 3, the frame 3 may be made from a plastic or a metal material. In this embodiment, the frame 3 is made from a plastic material, and is connected to the U-shaped soft iron 21 by means of injection molding. The frame 3 and the U-shaped soft iron 21 are made into an integral body by means of in-mold injection molding. This not only saves the assembling time, but also achieves a higher assembling precision. In addition, this prevents the vibration film 11 from contacting the side face of the magnet during up-down vibration. In addition, a plastic frame may reduce the flux leakage coefficient of the magnetic system relative to an iron frame.

In the magnetic system 2, the U-shaped soft iron 21 is made from a low-carbon steel material, a vent hole 211 is provided at the bottom thereof, and the acoustic foam 4 is adhered to the vent hole 211. It should be noted that the bottom of the U-shaped soft iron 21 is provided with a vent hole 211, which effectively reduces the air resistance in the magnetic system 2 during vibration of the vibration film 11, and facilitates the smoothness of the vibration system 1. The acoustic foam 4 is adhered to the bottom face of the U-shaped soft iron 21, and is adhered to the vent hole 211, which may effectively reduce wind noise when the air passes through the vent hole 211 at the bottom of the U-shaped soft iron 21 at a very high speed during operation of the full-frequency speaker.

The bar-shaped magnet 22 is a rectangular neodymium magnet, and provides a permanent magnetic field for the planar voice coil 12, which employs a magnet with a high magnetic energy product. In this embodiment, the bar-shaped magnet 22 is a neodymium magnet, and to form an effective magnetic field loop, adjacent bar-shaped magnets need to be magnetized reversely. To solve the problem that the bar-shaped magnet has a large length which is unfavorable to production, each bar-shaped magnet 22 in this embodiment is formed of three small square magnets 221, which bring convenience to the production.

In the full-frequency speaker in this embodiment, since the upper magnetic conduction plate of the traditional moving coil speaker is not provided, the integral magnetic system 2 may be made to be very thin, and the integral magnetic system 2 has a thickness of only 4 mm. As described in the above vibration system 1, the planar voice coil has a thickness of only 0.1 mm and the vibration film 11 has a thickness of only 2.9 mm, and thus the integral vibration system 1 has a thickness of only 3 mm. With the thickness of the frame 3 and the acoustic foam 4, the integral full-frequency speaker has a thickness of 8 mm, which satisfies the design requirement of the ultra-thin structure while achieving the full-range performance.

The novel ultra-thin planar magnetic film full-frequency speaker in this embodiment, integrating the advantages of the moving coil speaker and the planar magnetic film speaker, has a simple and compact structure, and employs a magnetic path design similar to that of the planar magnetic film, with a height being controlled within 8 mm. In addition, the planar voice coil is adhered to the vibration film having a special shape as the driving force, and the inner R-shaped edge design is used. In this way, a specific mechanical excursion is ensured, and the compliance of the edge is increased to lower the resonant frequency. Meanwhile, the vibration film is subject to a uniform force, there are few the partition vibrations and rocking modes, the effective frequency domain is wide, thereby forming an ultra-thin full-frequency speaker (150 Hz to 20 kHz), which is extensively applied in small and light-weighted electronic devices.

Embodiment 2

Figure 6:
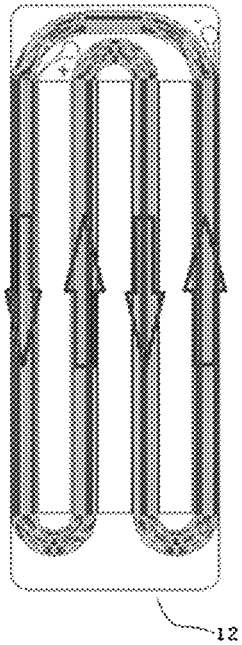
FIG. 6 is a schematic view of positive current feed of the planar voice coil.
Figure 7:
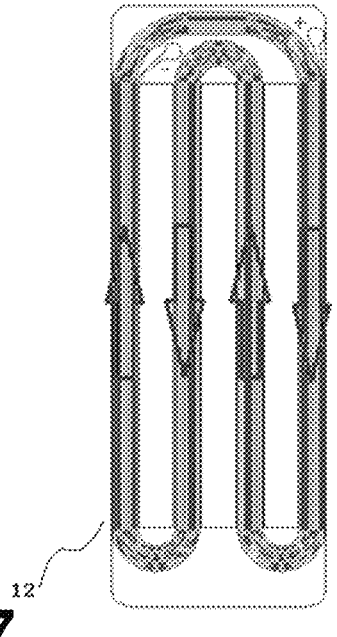
FIG. 7 is a schematic view of negative current feed of the planar voice coil.
Figure 8:
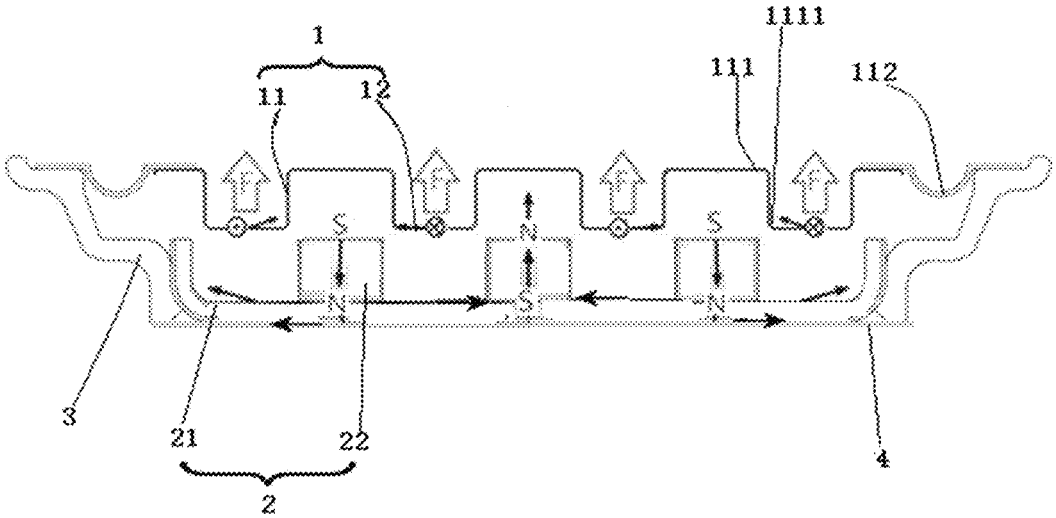
FIG. 8 is a schematic view of force of a vibration film in case of positive current feed of the planar voice coil.
Figure 9:
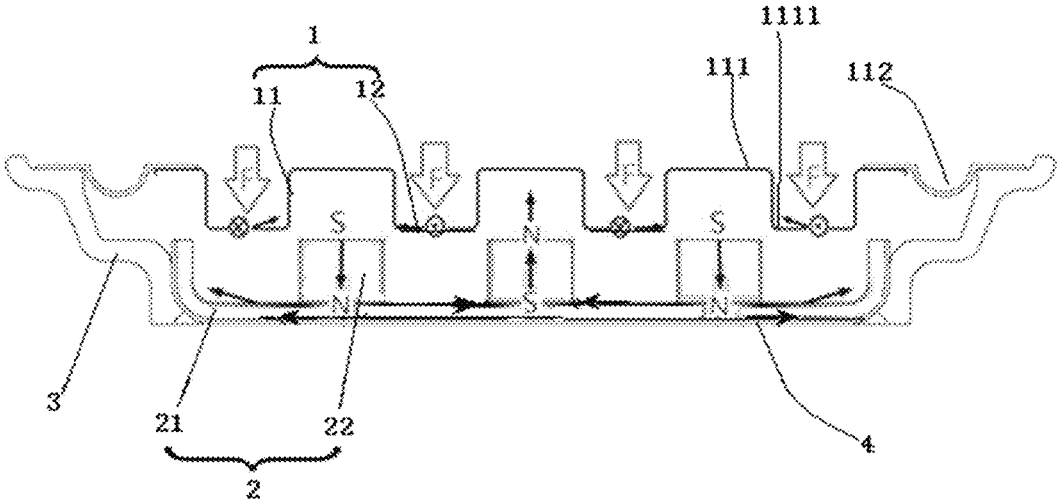
FIG. 9 is a schematic view of force of a vibration film in case of negative current feed of the planar voice coil.

FIG. 6 and FIG. 7 respectively provide a schematic view of positive current feed of the planar voice coil and a schematic view of negative current feed of the planar voice coil according to this embodiment. FIG. 8 and FIG. 8 respectively provide a schematic view of force of a vibration film in case of positive current feed of the planar voice coil and a schematic view of force of a vibration film in case of negative current feed of the planar voice coil according to this embodiment. With reference to FIG. 6 to FIG. 9, when the current enters from the positive electrode of the planar voice coil 12, a flow direction of the current inside the planar voice coil 12 is as illustrated by the arrows in FIG. 6, and correspondingly, in FIG. 8, the planar voice coil 12 is integrally subject to an upward Ampere force, such that the vibration film 11 is driven to move upward; when the current enters from the negative electrode of the planar voice coil 12, a flow direction of the current inside the planar voice coil 12 is as illustrated by the arrows in FIG. 7, and correspondingly, in FIG. 9, the planar voice coil 12 is integrally subject to a downward Ampere force, such that the vibration film 11 is driven to move downward.

Figure 10:
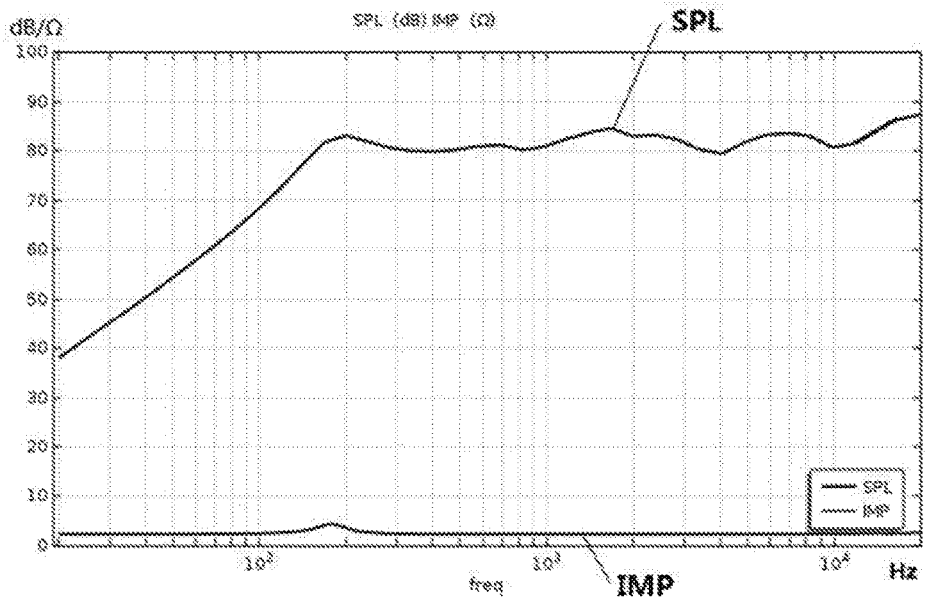
FIG. 10 is a finished product view of a frequency response curve and an impedance curve of the ultra-thin planar magnetic film full-frequency speaker.
Figure 11:
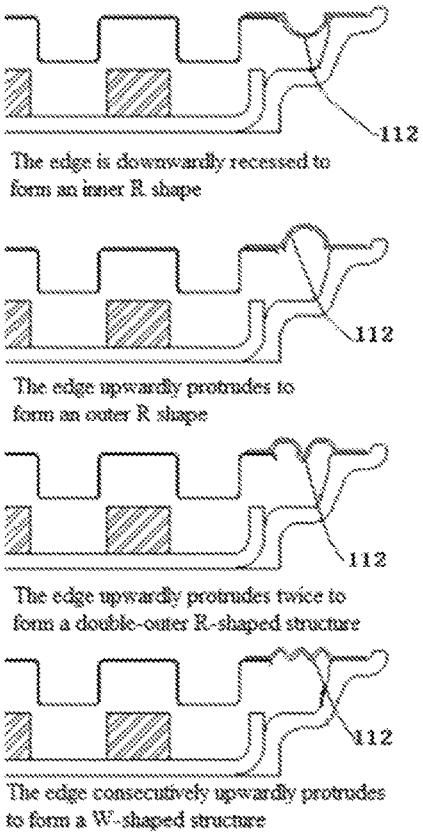
FIG. 11 is a schematic structural view of different shapes formed by an edge.

FIG. 10 is a finished product view of a frequency response curve and an impedance curve of the ultra-thin planar magnetic film full-frequency speaker according to this embodiment. As illustrated in FIG. 10, in this embodiment, the effective frequency domain is wide (180 Hz to 20 kHz), and the SPL curve is flat; and in addition, the impedance curve is flat, and the inductive reactance and motional impedance are small.

Described above are merely several exemplary embodiments for illustration of the exemplary embodiments, which are specifically described in detail. However, these embodiments shall not be construed as limitations to the scope of the present invention. It should be noted that persons of ordinary skill in the art may derive various variations and modifications without departing from the inventive concept of the present invention. Such variations and modifications shall pertain to the protection scope of the present invention.

What is claimed:

1. An ultra-thin planar magnetic film full-frequency speaker, characterized in that, it comprises: a vibration system, a magnetic system, a frame, and an acoustic foam; wherein the vibration system and the magnetic system are received and fixed in the interior of the frame;

the vibration system comprises a vibration film and a planar voice coil, the vibration film forming a contiguous inward recess structure in the middle thereof, the planar voice coil being extended around a bar shaped aperture, and the planar voice coil being adhered and fixed to the vibration film; and the magnetic system comprises a U-shaped soft iron and a bar-shaped magnet, the bar-shaped magnet being disposed above the U-shaped soft iron and disposed beneath the bar-shaped aperture, the U-shaped soft iron being connected to the frame by means of injection molding, and the acoustic foam being adhered to a bottom face of the U-shaped soft iron.

2. The ultra-thin planar magnetic film full-frequency speaker according to claim 1, wherein the vibration film comprises a vibration plate and an edge surrounding the vibration plate, the vibration film being fixed and connected to the edge by means of bonding or in-mold injection molding, and the vibration film being adhered and fixed to the frame by means of the edge.

3. The ultra-thin planar magnetic film full-frequency speaker according to claim 2, wherein the vibration plate downwardly forms a contiguous square groove, and the vibration plate has a square wave form-shaped section.

4. The ultra-thin planar magnetic film full-frequency speaker according to claim 3, wherein the vibration plate is made from an aluminum magnesium alloy or a plastic polymer material, and the vibration plate is additionally provided with a reinforcing rib.

5. The ultra-thin planar magnetic film full-frequency speaker according to claim 2, wherein the edge is downwardly recessed to form an inner R-shaped structure, or upwardly protrudes to form an outer R-shaped structure, or upwardly protrudes twice to form a double-outer R-shaped structure, or consecutively upwardly protrudes to form a W-shaped structure; and the edge is made from a rubber material or a polyurethane material or a silk material, and the edge is additionally provided with a reinforcing rib.

6. The ultra-thin planar magnetic film full-frequency speaker according to claim 1, wherein the planar voice coil comprises a conductive coil and a planar thin film, the conductive coil being printed on the planar thin film, and the bar-shaped aperture being provided in the planar thin film.

7. The ultra-thin planar magnetic film full-frequency speaker according to claim 6, wherein the conductive coil comprises a linear coil portion and a bent coil portion, the linear coil portion being adhered and fixed to a contiguous square groove, and the bent coil portion being adhered to two sides of the vibration film.

8. The ultra-thin planar magnetic film full-frequency speaker according to claim 1, wherein the bottom of the U-shaped soft iron is provided with a vent hole, the acoustic foam being adhered to the vent hole.

9. The ultra-thin planar magnetic film full-frequency speaker according to claim 1, wherein the bar-shaped magnet is a rectangular neodymium magnet, and each bar-shaped magnet is formed of three small square magnets.

10. The ultra-thin planar magnetic film full-frequency speaker according to claim 1, wherein the ultra-thin planar magnetic film full-frequency speaker has an integral thickness of not greater than 8 mm.

* * * * *